US006938762B2

(12) United States Patent
Cheng

(10) Patent No.: US 6,938,762 B2
(45) Date of Patent: Sep. 6, 2005

(54) BASE OF GOLF CLUB BAG

(76) Inventor: Te Pin Cheng, No. 304, Tu-Shin Rd., Taichung City (TW)

( * ) Notice: Subject to any disclaimer, the term of this patent is extended or adjusted under 35 U.S.C. 154(b) by 0 days.

(21) Appl. No.: 10/445,951

(22) Filed: May 28, 2003

(65) Prior Publication Data

US 2004/0238386 A1 Dec. 2, 2004

(51) Int. Cl.[7] ..... A63B 55/00
(52) U.S. Cl. ..... 206/315.3; 248/96
(58) Field of Search ..... 206/315.7, 315.3, 206/315.8; 248/96

(56) References Cited

U.S. PATENT DOCUMENTS

| | | | | | |
|---|---|---|---|---|---|
| 877,353 | A | * | 1/1908 | Marker | 206/315.8 |
| 1,122,721 | A | * | 12/1914 | Gamble | 206/315.8 |
| 1,254,640 | A | * | 1/1918 | Stevenson | 206/315.8 |
| 1,419,425 | A | * | 6/1922 | Terr | 206/315.8 |
| 4,834,235 | A | | 5/1989 | Solheim | |
| 6,062,383 | A | | 5/2000 | Han | |
| 6,386,362 | B1 | | 5/2002 | Cheng | |
| 6,564,937 | B1 | * | 5/2003 | Cheng | 206/315.7 |
| 6,568,527 | B1 | * | 5/2003 | Te-Pin | 206/315.3 |

* cited by examiner

*Primary Examiner*—Lien M. Ngo
(74) *Attorney, Agent, or Firm*—Dennison, Schultz, Dougherty & MacDonald

(57) ABSTRACT

A golf club bag is mainly composed of a base and a bag member, where in the base has a main member made of a flexible material having a bottom portion, a sidewall at a periphery of the bottom portion, a flexible section at the bottom portion and a fixed section and a movable section at opposite sides of the flexible section respectively, wherein the bottom portion is bendable along the flexible section, and a supporting device made of a material that harder than the main member, wherein the supporting device is surrounded by the bottom portion of the main member having a front section inside the fixed section, a rear section inside the movable section and a mid section between the front section and the rear section and inside the flexible section, wherein the mid section has a thickness thinner than the front section and the rear section.

5 Claims, 4 Drawing Sheets

BASE OF GOLF CLUB BAG

BACKGROUND OF THE INVENTION

1. Field of the Invention

The present invention relates generally to a golf club bag, and more particularly to a base of the golf club bag, which has a soft main body to be bonded with a bag and has a rigid bottom to keep a predetermined shape thereof.

2. Description of the Related Art

A conventional golf club bag taught in U.S. Pat. No. 4,834,235 is capable of standing on the ground itself. The golf club bag comprises a base, a bag bonded with the base, a pair of standings pivoted on the bag and two elastic members connecting opposite ends thereof to the base and the standings respectively. The standings move for extension or flexion. The bag of such golf club bag has a movable frame so that the golf club bag always is twisted or toppled over.

U.S. Pat. No. 6,062,383 disclosed a golf club bag having a bendable base to overcome the drawbacks of aforesaid golf club bag. The base has two sub-bases and hinges to pivot them together which sand or water will run into the bag via the gap between the sub-bases.

U.S. Pat. No. 6,386,362 disclosed a golf club bag having a base with plural of isolated chambers therein for improvement. The base provides soft elements to bond rigid elements with the chambers therein. It is hard to bond the rigid elements together by the soft elements.

The bases of aforesaid patents are made of rigid plastic to support the bag bonded thereon. It is hard to stitch the bag onto tile hard base. The stitch portion of the golf club bag always is damaged while tile bag is loaded with heavy goods therein.

SUMMARY OF THE INVENTION

The primary objective of the present invention is to provide a base of a golf club bag, which is damped between the base and the bag.

The secondary objective of the present invention is to provide a base of a golf club bag, which provides a high efficiency in assembling the base and the bag.

According to the objectives of the present invention, a base of a golf club bag comprises a main member made of a flexible material and molded into a single element having a bottom portion, a sidewall at a periphery of the bottom portion, a flexible section at a predetermined position of the bottom portion and a fixed section and a movable section at opposite sides of the flexible section respectively, wherein the bottom portion is bendable along the flexible section, and a supporting device made of a material that harder than the main member and molded into a single element, wherein tile supporting device is surrounded by the bottom portion of the main member having a front section inside the fixed section, a rear section inside the movable section and a mid section between the front section and the rear section and inside the flexible section, wherein the mid section has a thickness thinner than the front section and the rear section.

DETAILED DESCRIPTION OF THE INVENTION

Figure 1:
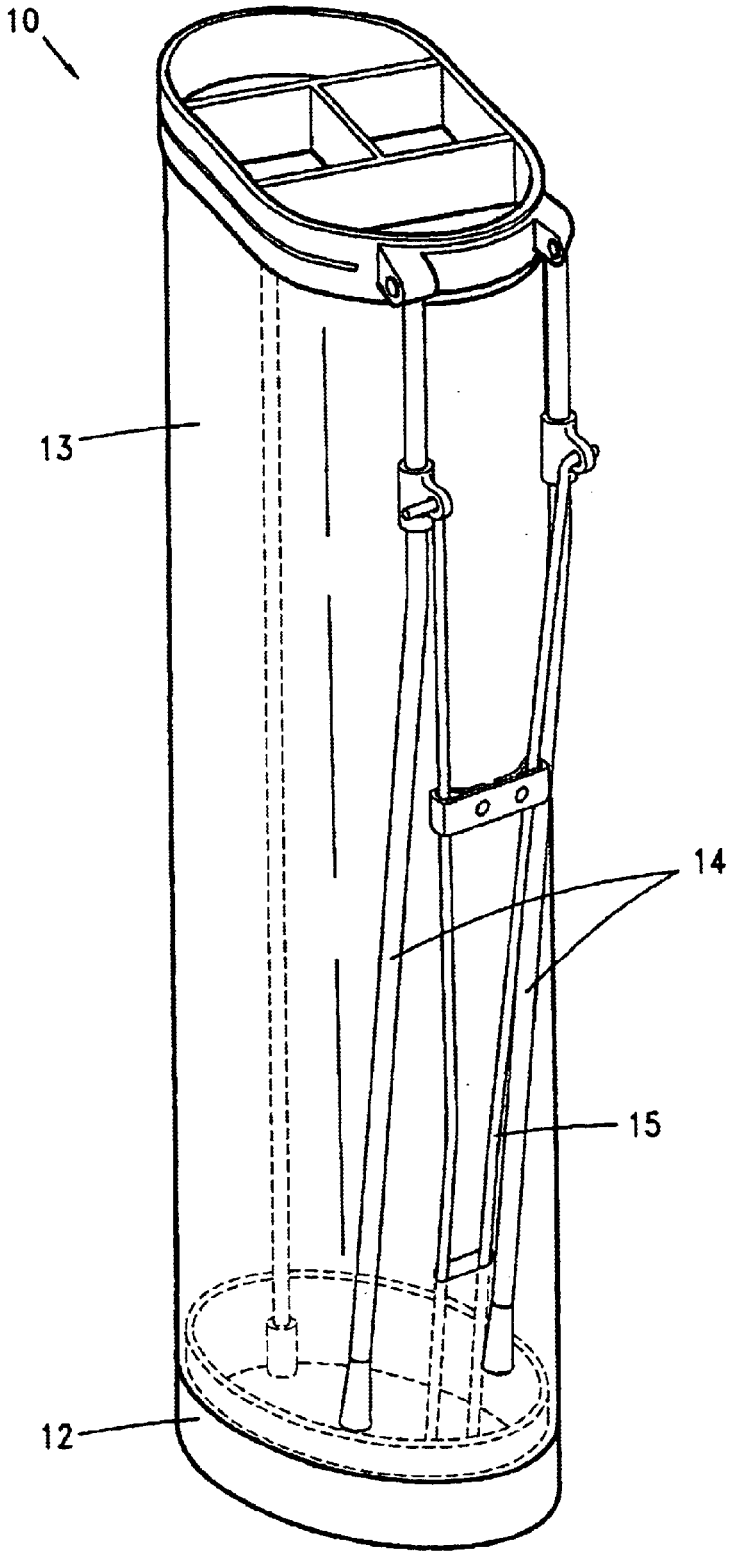
FIG. 1 is a perspective view of a first preferred embodiment of the present invention.
Figure 2:
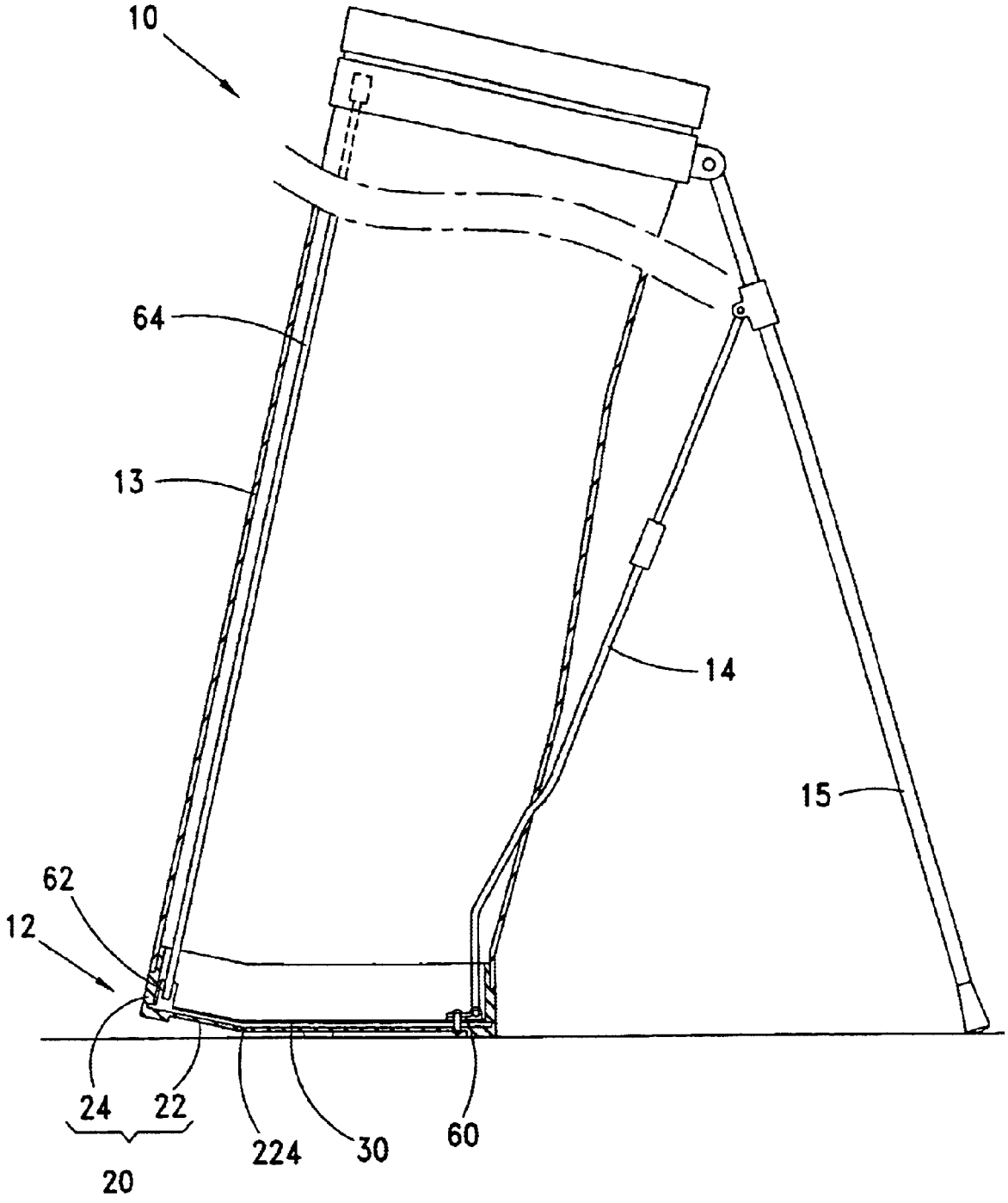
FIG. 2 is a side view of the first preferred embodiment of the present invention.
Figure 3:
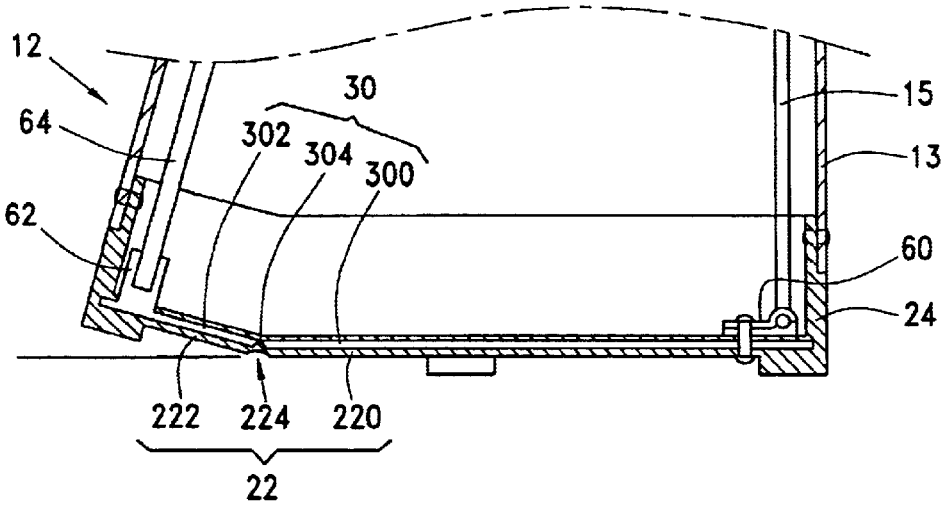
FIG. 3 is a sectional view of the first preferred embodiment of the present invention.

As shown in FIGS. form FIG. 1 to FIG. 3, a golf club bag 10 is composed of a base 12, a bag member 13 bonded on the base 12, a pair of standings 14 pivoted on the bag member 13 and an elastic member 15 having opposite ends thereof pivoted on the base 12 and the standings 14 respectively.

The base 12 has a main member 20 in which a chamber is formed and a supporting device 30 to support the main member 20.

The main member 20 is made of a soft thermoplastic material and is molded into a single element. The main member 20 has a substantially elliptical bottom portion 22 on which has a fixed section 220, a movable section 222 and a flexible section 224 between the fixed section 220 and the movable section 222. The flexible section 224 is an elongated recess on a bottom of the bottom portion 22 with a suitable length and depth in the present preferred embodiment. The bottom portion 22 further has a sidewall 24 at a periphery thereof with a suitable height. The bottom portion 22 is flat while no external force is exerted on it so that the bottom portion 22 can be rested on the ground. While the bottom portion 22 is bent for the movable section 222 tilted upwards relative to the fixed section 220. The flexible section 224 serves as a hinge for the movable section 222. The sidewall 24 is curved or wrinkled while the bottom portion 22 is bent.

The supporting device 30 is made of a thermoplastic material harder than the main member 20 and is molded inside of the main member 20 while the main member 20 is molded. The supporting device 30 has a front section 300 inside of the fixed section 220, a rear section 302 inside of the movable section 222 and a mid section 304 between the front and rear sections 300 and 302 and inside the flexible section 224. A thickness of the supporting device 30 at where the mid section 304 is thinner than thickness thereof at where the front and rear sections 300 and 302 are. Tile mid section 304 is a recess at a bottom of the supporting device 30 in the present preferred embodiment. The mid section 304 makes the supporting device 30 being bendable.

The base 12 farther has a pivoting device 60 having an end thereof pivoted on a bottom end of the elastic member 14 and the other end thereof fixed on an inner side of the base 12 by a rivet that is nailed on both of the main member 20 and the Supporting device 30. The rear section 302 has a connector 62 at a rear end thereof and inside the sidewall 24. The connector 62 is also a part of the rear section 302 and is a tube-like element with a recess at a top thereof. A supporting shaft 64 at a rear side of the bag member 13 has an end received in the recess of the supporting device 62 such that both of the supporting shaft 64 and the elastic device work together for supporting tile bag member 13.

The main member 20 of the present invention has a suitable flexibility so that even the rivet is nailed on the base 12, the soft main member 20 surrounds the supporting device 30 at both sides thereof so that it covers both ends of the rivet in well condition. Similarly, the main member 20 serves as a well cover for the stitching portion of the bag member 13. The damping capacity of the main member 20 protects the stitching portion of the bag member 13 from being damaged.

Figure 4:
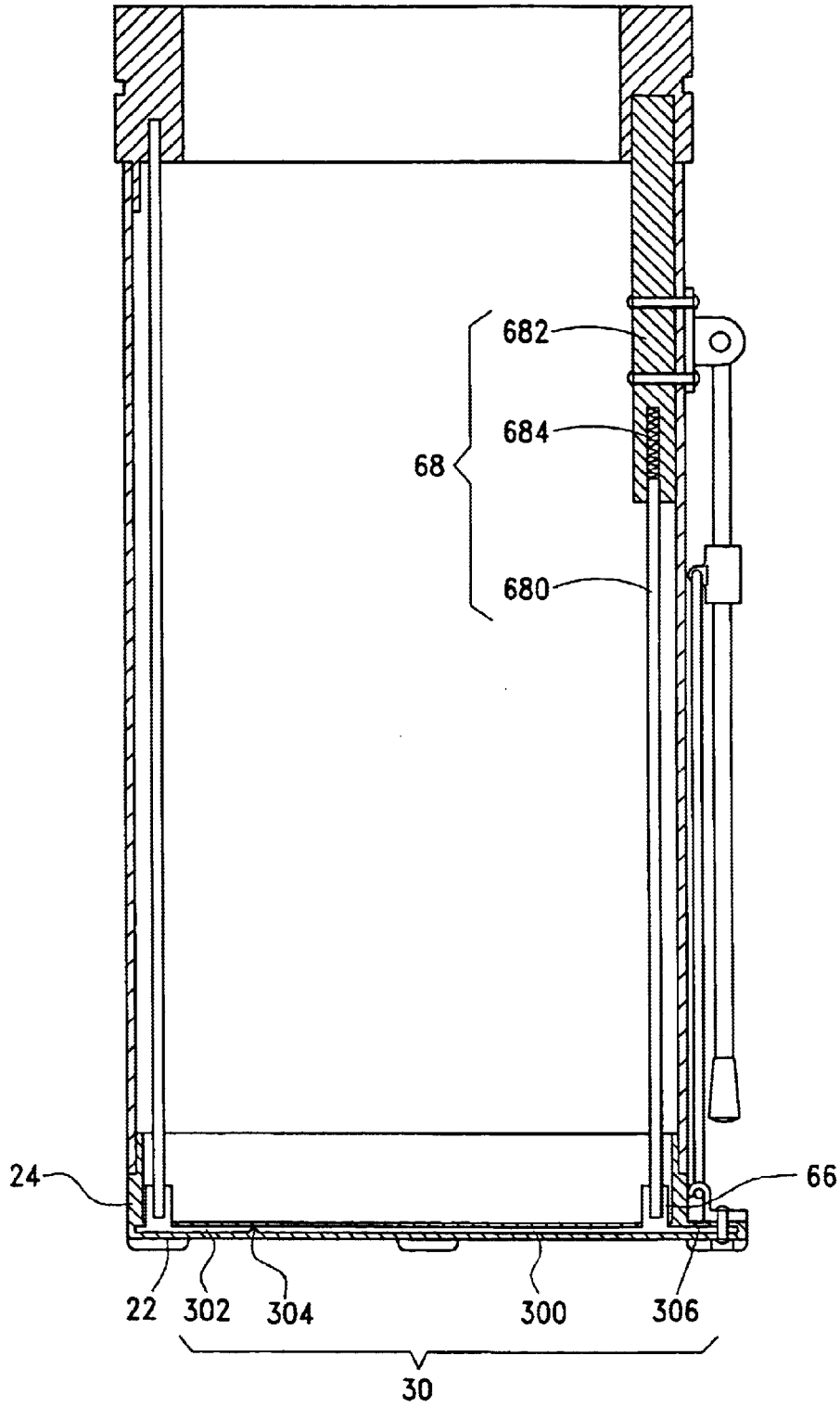
FIG. 4 is a sectional view of a second preferred embodiment of the present invention.

As shown in FIG. 4, a golf club bag 10 of the second preferred embodiment of the present invention provides an elastic device 14 outside a bag member 13. It is different from the elastic device 14 being provided inside the bad member 13 in the first preferred embodiment. A supporting device 30 has an extended portion 306 extended outwards from an outer side of a sidewall 24 and the extended portion is still surrounded by a main member 20. A pivoting device 60 has an end thereof fixed to the extended portion 306.

The golf club bag 10 of the second preferred embodiment of the present invention further provides a second connector 66 at a front end of a front section 300 and inside the sidewall 24. The second connector 66 and the front section 300 are molded into a single element. A second supporting shaft 68 consists of an inner tube 680, an outer tube 682 and a spring 684 at between the tubes 680 and 682. The inner tube 680 has a bottom end inserted into the second connector 66 and the outer tube 682 is fixed to standings 15.

Figure 5:
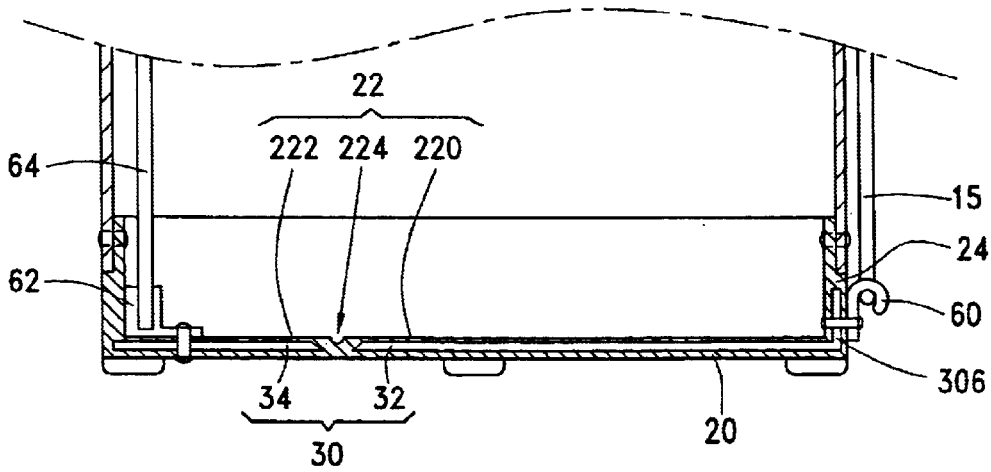
FIG. 5 is a sectional view of a third preferred embodiment of the present invention.

FIG. 5 shows the third preferred embodiment of the present invention which a supporting device 30 is constructed from two parts having a first supporting board 32 and a second supporting board 34 and the first and second boards 32 and 34 keep a suitable distance from each other. The first supporting board 32 is surrounded by a fixed section 222 and between the first and second supporting boards 32 and 34 is a flexible section 224. The flexible section 224 is an elongated recess on a top with a suitable length and a suitable depth. The first supporting board 32 has an extended portion 306 at an end thereof which the extended portion 306 extends upwards and has a height shorter than a sidewall 24. A pivoting device 60 is fixed to the sidewall 24 and the extended portion 306.

In the above preferred embodiments, the supporting device 30 is surrounded by the main member 20. In practice, it can provide plural of rivets nailed to the fixed section 220 and the movable section respectively so that the main member 20 is kept a predetermined shape and the bottom portion 22 is bendable.

What is claimed is:

1. A base of a golf club bag, comprising:

a main member made of a flexible material and molded into a single element having a bottom portion, a sidewall at a periphery of the bottom portion, a flexible section at a predetermined position of the bottom portion and a fixed section and a movable section at opposite sides of the flexible section respectively, wherein the bottom portion is bendable along the flexible section, and a supporting device made of a material that harder than the main member and molded into a single element, wherein the supporting device is surrounded by the bottom portion of the main member having a front section inside the fixed section, a rear section inside the movable section and a mid section between the front section and the rear section and inside the flexible section, wherein the mid section has a thickness thinner than the front section and the rear section.

2. The base as defined in claim 1, wherein the flexible section has a recess at a bottom thereof with a predetermined length and a predetermined depth.

3. The base as defined in claim 1, wherein the mid section has a recess at a bottom thereof with a predetermined length and a predetermined depth.

4. The base as defined in claim 1, wherein the rear section has a first connector inside the sidewall of the main member, wherein the first connector is a tube-like element and is molded on the rear section as a single element.

5. The base as defined in claim 1, further comprising an extended portion at a rear end of the front section and a pivoting device fixed to both of the extended portion main member, wherein the extended portion and the front section are molded into a single element and the extended portion is surrounded by the main member.

* * * * *